US012060782B2

(12) United States Patent
Al Juhani et al.

(10) Patent No.: US 12,060,782 B2
(45) Date of Patent: Aug. 13, 2024

(54) ELECTRICAL TREATMENT TO REVIVE DEAD GAS WELLS DUE TO WATER BLOCKAGE

(71) Applicant: SAUDI ARABIAN OIL COMPANY, Dhahran (SA)

(72) Inventors: Ghaida Al Juhani, Dammam (SA); Subhash C. Ayirala, Dhahran (SA); Abdulaziz S. Al-Qasim, Dammam (SA); Deena Tayyib, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/990,537

(22) Filed: Nov. 18, 2022

(65) Prior Publication Data

US 2024/0167371 A1 May 23, 2024

(51) Int. Cl.
*E21B 43/24* (2006.01)
*E21B 43/25* (2006.01)

(52) U.S. Cl.
CPC ..... *E21B 43/2401* (2013.01); *E21B 43/25* (2013.01)

(58) Field of Classification Search
CPC ..... E21B 43/2401; E21B 43/25
See application file for complete search history.

(56) References Cited

U.S. PATENT DOCUMENTS 4,228,854 A 10/1980 Sacuta
5,099,918 A 3/1992 Bridges et al.
5,282,508 A * 2/1994 Ellingsen ..... E21B 17/003 166/65.1
5,597,042 A 1/1997 Tubel et al.
5,751,895 A 5/1998 Bridges
(Continued)

FOREIGN PATENT DOCUMENTS

RU 2102587 C1 1/1998
WO 1998028970 A2 7/1998
WO 2011001792 A1 1/2011

OTHER PUBLICATIONS

Wittle et al., "Direct Current Electrical Enhanced Oil Recovery in Heavy-Oil Reservoirs to Improve Recovery, Reduce Water Cut, and Reduce H2S Production While Increasing API Gravity", SPE International Paper No. SPE-114012, 2008 (20 pages).
(Continued)

*Primary Examiner* — Brad Harcourt
(74) *Attorney, Agent, or Firm* — Osha Bergman Watanabe & Burton LLP

(57) ABSTRACT

A system for electrical treatment in a reservoir with gas wells is disclosed. The system includes a first well in the reservoir configured to act as an electrode, the reservoir having a plurality of pore spaces saturated by water, and a second well in the reservoir configured to act as a second electrode hydraulically connected to the first well. A power unit is connected to the first and second wells by a cable configured to emit an electric current to the first well and the second well into the reservoir. The electric current enlarges the plurality of pore spaces in the reservoir, facilitating a production of gas from the water. A transformer is connected to the power unit by the cable, the transformer being configured to step down a voltage from a power supply to the power unit. The power supply is connected to the transformer by the cable.

14 Claims, 13 Drawing Sheets

(56) References Cited

U.S. PATENT DOCUMENTS

| | | | | |
|---|---|---|---|---|
| 6,405,797 | B2 | 6/2002 | Davidson et al. | |
| 2007/0102152 | A1* | 5/2007 | Forgeron | E21B 43/2401 166/302 |
| 2011/0315374 | A1 | 12/2011 | Rybakov | |
| 2013/0112403 | A1* | 5/2013 | Meurer | E21B 43/267 166/248 |
| 2014/0218208 | A1 | 8/2014 | Hudson | |
| 2019/0112906 | A1* | 4/2019 | Dieckmann | E21B 33/14 |

OTHER PUBLICATIONS

Chen et al., "Coalescence of Pickering Emulsion Droplets Induced by Electric Field", Physics Review Letters, vol. 110, No. 6, 2013 (5 pages).

Rudyk, S. et al., "Enhancing oil recovery by electric current impulses well treatment: A case of marginal field from Oman", Fuel 314, 2022 (10 pages).

Chen et al., "Experimental Study on Tight Sandstone Reservoir Gas Permeability Improvement Using Electric Heating", Energies, 15, 1438, 2022 (14 pages).

Ikpeka et al., "Effectiveness of electrokinetic-enhanced oil recovery (EK-EOR): a systematic review", Journal of Engineering and Applied Science, 2022 (27 pages).

International Search Report and Written Opinion issued in Application No. PCT/US2023/079823, mailed on Mar. 5, 2024 (15 pages).

* cited by examiner

ELECTRICAL TREATMENT TO REVIVE DEAD GAS WELLS DUE TO WATER BLOCKAGE

BACKGROUND

The disclosure relates generally to applying electrical treatment to dead gas wells blocked by water. Dead gas wells are wells that are no longer capable of producing gas economically. Such water blockage occurs when the surrounding region around a wellbore is in contact with water for a long period of time. This long period of contact results in water saturation increasing relative to the gas saturation. Consequently, the pore spaces of the reservoir become occupied with water blocking the flow of gas and reducing the gas production.

Accordingly, there exists a need for an electrical treatment to enlarge the pore spaces facilitating production of gas recovering the dead gas wells.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a system for electrical treatment in a reservoir with gas wells, the system including a first well in the reservoir configured to act as an electrode, the reservoir having a plurality of pore spaces saturated by water, and a second well in the reservoir configured to act as a second electrode hydraulically connected to the first well. A power unit is connected to the first well and the second well by a cable configured to emit an electric current to the first well and the second well into the reservoir. The electric current enlarges the plurality of pore spaces in the reservoir, facilitating a production of gas from the water. A transformer is connected to the power unit by the cable, the transformer being configured to step down a voltage from a power supply to the power unit. The power supply is connected to the transformer by the cable.

In general, in one aspect, the invention relates to a method for electrical treatment in a reservoir with gas wells. The method involves supplying power by a power supply connected to a transformer by a cable to a power unit, wherein the transformer is configured to step down a voltage from the power supply to the power unit, applying an electric current by the power unit through a first well and a second well into the reservoir, wherein the first well, configured to act as a first electrode, is hydraulically connected to the second well that is configured to act as a second electrode, enlarging a plurality of pore spaces in the reservoir by application of the electric current, wherein the plurality of pore spaces is saturated with water, and releasing water from the plurality of pore spaces by the enlargement of the plurality of pore spaces.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to methods for reviving dead gas wells from water blockage by the application of electrical treatment. Water blockage hinders the ability to extract water from a gas well and formation damage may occur. In one or more embodiments, the electrical treatment to revive the dead gas wells is initiated by a power supply emitting electric current. After current is applied to a well head, the charge propagates through metallic casing along the well until it reaches the pay zone delivering to the reservoir. When electric current is applied, a mechanical destruction of the blocked pore space occurs, which results in an increase in permeability. The increase in pore throat radius creates a space for water to move and be released from pore spaces. The occurrence of partial electrolysis due to passing of electric current leads to gas bubbles formation from released water. Electric current also improves the connectivity of released water droplets for easy mobilization and removal.

Embodiments of the present disclosure may provide at least one of the following advantages. Electrical treatment to reverse the unforeseen process of water blockage, recover dead gas wells to produce desired gas results in prolonging the life of the gas wells. Further, electro-enhanced oil recovery (EEOR) has a low carbon footprint and sustainable eco-friendly.

Figure 1:
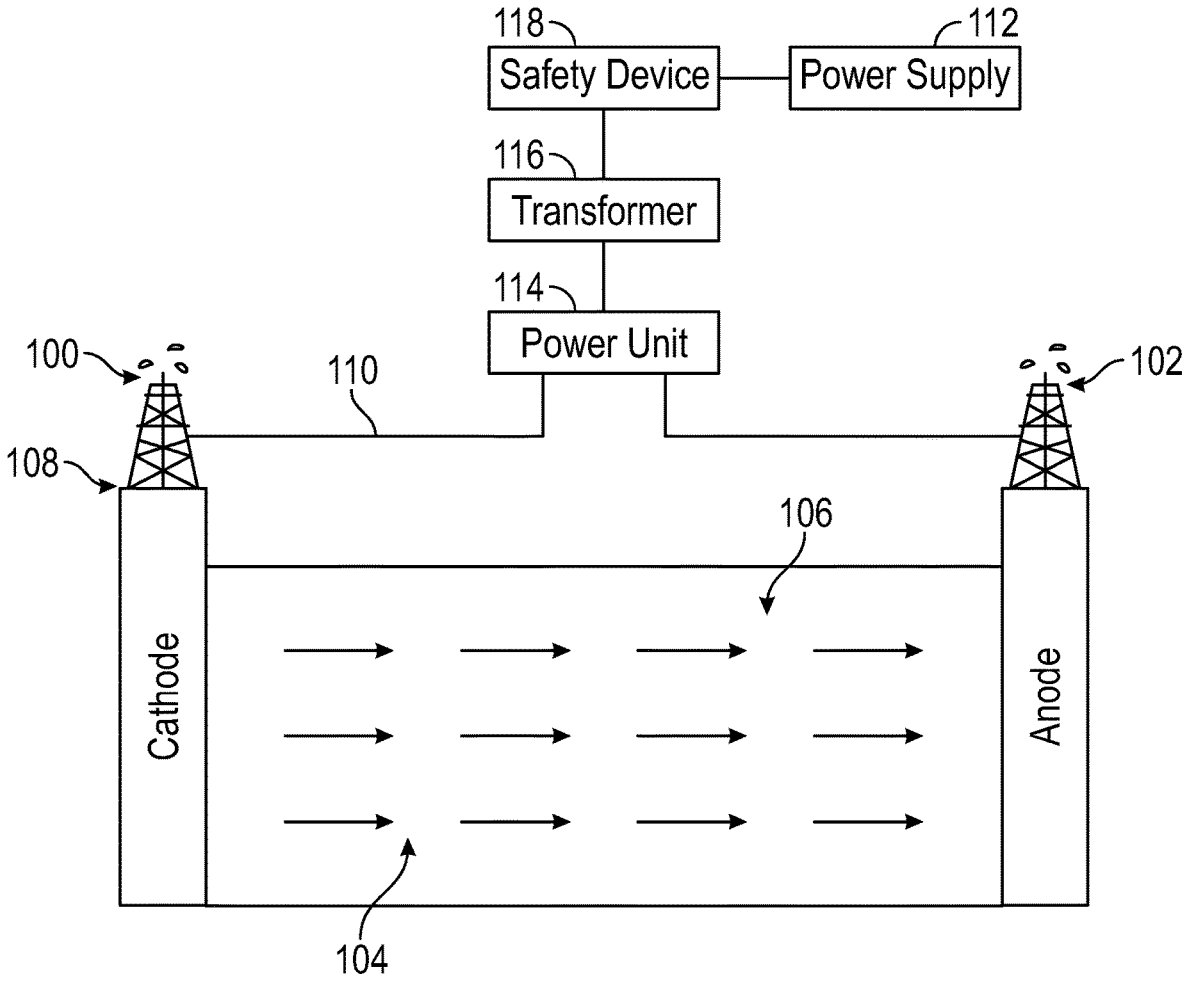
FIG. 1 shows an electrical arrangement of a system in accordance with one or more embodiments.

FIG. 1 shows an electrical arrangement of a system for electrical treatment in accordance with one or more embodiments. Specifically, FIG. 1 shows a system of two vertical gas wells, a first well (100) and a second well (102), in a reservoir (104). In one or more embodiments, the first well (100) and the second well (102) are blocked by water. The first well (100) and second well (102) may be perforated wells or horizontal wells of different configurations. The system may extend to different laterals as long as the blocked area of water is located near two laterals for utilization, one as a source (cathode) and the other as a sink (anode). A gas well generally provides for extraction of gas and other wellbore fluids from a plurality of pore spaces (106) in the reservoir (104) in the earth and transport of such fluids to the surface (108) of the gas well. The pore spaces (106) in rock in the reservoir (104) may contain oil, gas, or water. The first well (100) and the second well (102) may be dead gas wells. Dead gas wells may be wells which are no longer capable of producing gas economically. Gas wells may become dead gas wells due to the pore spaces (106) being saturated by water. The reservoir (104) may have a higher water saturation relative to gas saturation. Pore spaces (106) may have a throat radius which refers to the size of the pore space (106).

Further, FIG. 1 shows the first well (100) and the second well (102) hydraulically connected by the reservoir (104). The first well (100) and second well (102) may act as electrodes. In one or more embodiments, the first well (100) is a cathode and the second well (102) is an anode. A cathode is an oxidizing electrode. An anode is a reducing electrode. The electrical arrangement may involve the placement of two electrodes in between two spaced wells or within the same well, wherein one electrode is a cathode and the other is an anode. The electrodes may cover a region of 2 to 3 km. The electrical induced effects into a reservoir (104) may vary according to the variation of the electric current density or voltage applied in between the two spaced electrodes. The first well (100) and the second well (102) are connected to a power unit by a power cable (110). The power cable (110) may be any electrical cable able to emit an electric current to the first well (100) and the second well (102) into the reservoir (104). The power cable (110) may include cable lines necessary to connect all the equipment in the system together such as the power supply (112), the power unit (114), a transformer (116), a safety device (118), the first well (100), and the second well (102). The power unit (114) may be connected to the transformer (116) by the power cable (110). The transformer (116) may be connected to the safety device (118) and a power supply (112). The transformer (116) is configured to step down voltage generated from the power supply (112) to the power unit (114). The transformer (116) transfers voltage from one circuit to another through mechanical induction. The safety device (118) may be any safety device with the ability to disconnect the power supply (112) in case of a safety hazard. The safety hazard may be a predetermined voltage. The safety device (118) may be protection controlled automatic equipment.

In one or more embodiments, an electrical treatment is initiated by the power supply (112) emitting electric current to the transformer (116). The transformer (116) steps down the electric current to the power unit (114). The electric current is applied from the power unit (114) to the first well (100) and the second well (102). The first well (100) and second well (102) may act as electrodes by the polarization of the power unit (114). The power unit (114) may conduct positive polarity to the cathode and negative polarity to the anode by connecting the metallic casing of the well to the power unit (114) through the power cable (100). The power unit (114) may be a battery. The electric current may propagate through metallic casing in the first well (100) and the second well (102) until a pay zone delivering to the reservoir (104). The pay zone may be part of the reservoir (104) that contains hydrocarbons.

When applying electrical treatment, a high voltage power supply (112) may be necessary for the source of energy. An example of the high voltage may be 200 to 500 KVA. The transformer (116) may lower the voltage to a required value. An example of the required voltage may be 100-120 V. The power cable (110) lines may include characteristics to decrease the amount of electricity lost while traveling through the cables. For example, the power cable (110) may be flexible, be single-core, be four thin copper wires with a cross section of 120 square mm, have a rubber or plastic coating, and not exceed 500 m in length. The arrows in FIG. 1 may represent the flow of current from the cathode to the anode in a closed circuit, the movement of water after electrical treatment, or the flow of electric field. The electric current may cause mechanical destruction of the blocked pore spaces (106) to increase permeability. The mechanical destruction may increase the throat radius of the pore spaces (106) creating a space for water to move and be released from the pore spaces (106). The water released from the pore spaces (106) by the electric current may form a plurality of gas droplets or bubbles due to the occurrence of partial electrolysis. The connectivity of the released water droplets may improve for easy mobilization and removal. The electrical treatment operation may take up to 30 hours with a long-lasting effect from 6 months up to 5 years.

Figure 2:
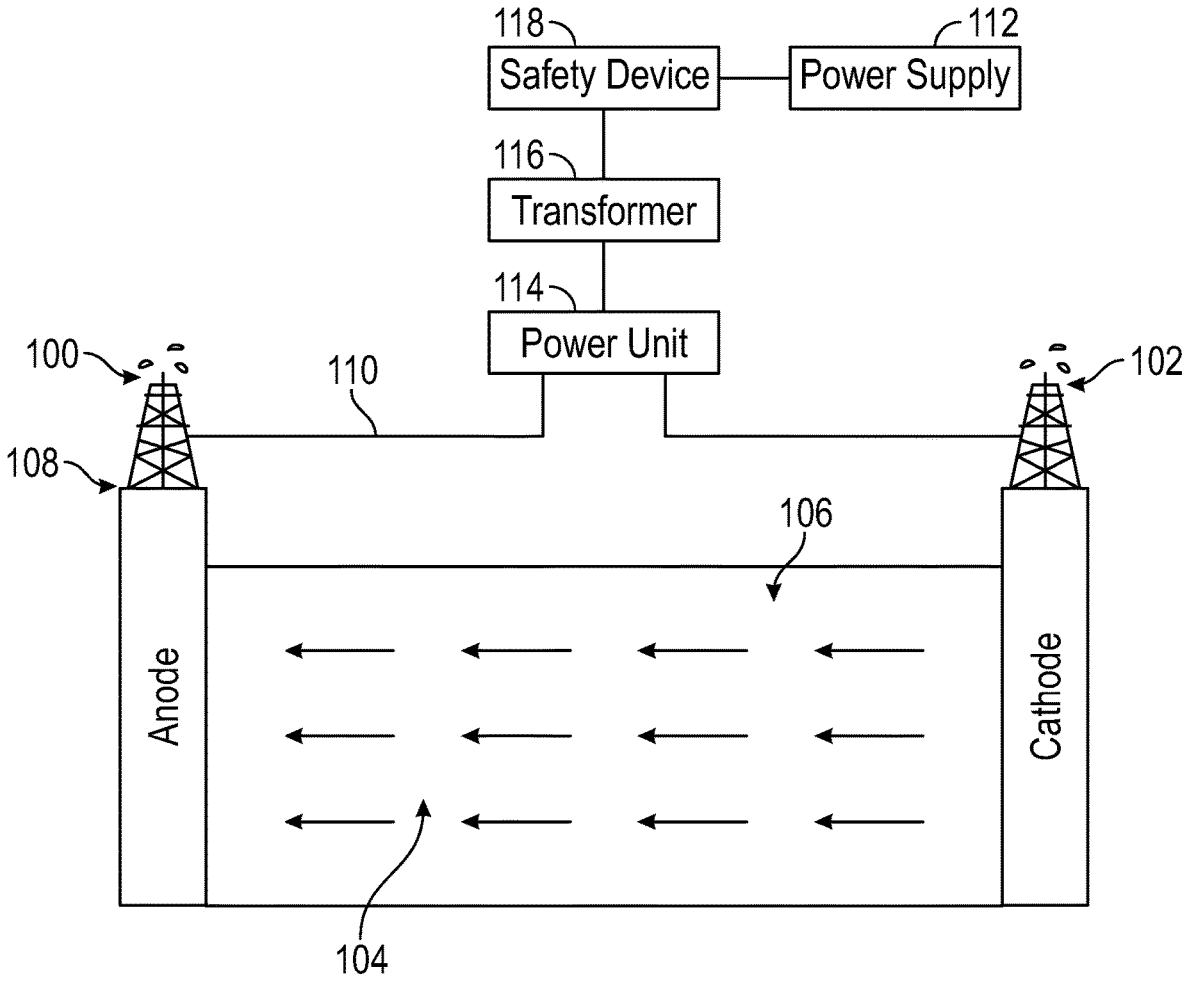
FIG. 2 shows an electrical arrangement of a system in accordance with one or more embodiments.

FIG. 2 shows the system of FIG. 1 in a different electrical arrangement with the first well (100) as the anode and the second well (102) as the cathode. That is, the placement of the cathode and anode is reversed in FIG. 2 as compared to FIG. 1. To achieve this result, the power cable (110) lines may be switched on the power unit (114) so that the first well (100) is connected to the negative polarity and the second well (102) is connected to the positive polarity. The placement of the cathode and anode in this reversed position reverses the attraction of the electrodes directing the movement of water and electric current in the opposite direction of FIG. 1 as shown by the arrows in FIG. 2.

Figure 3:
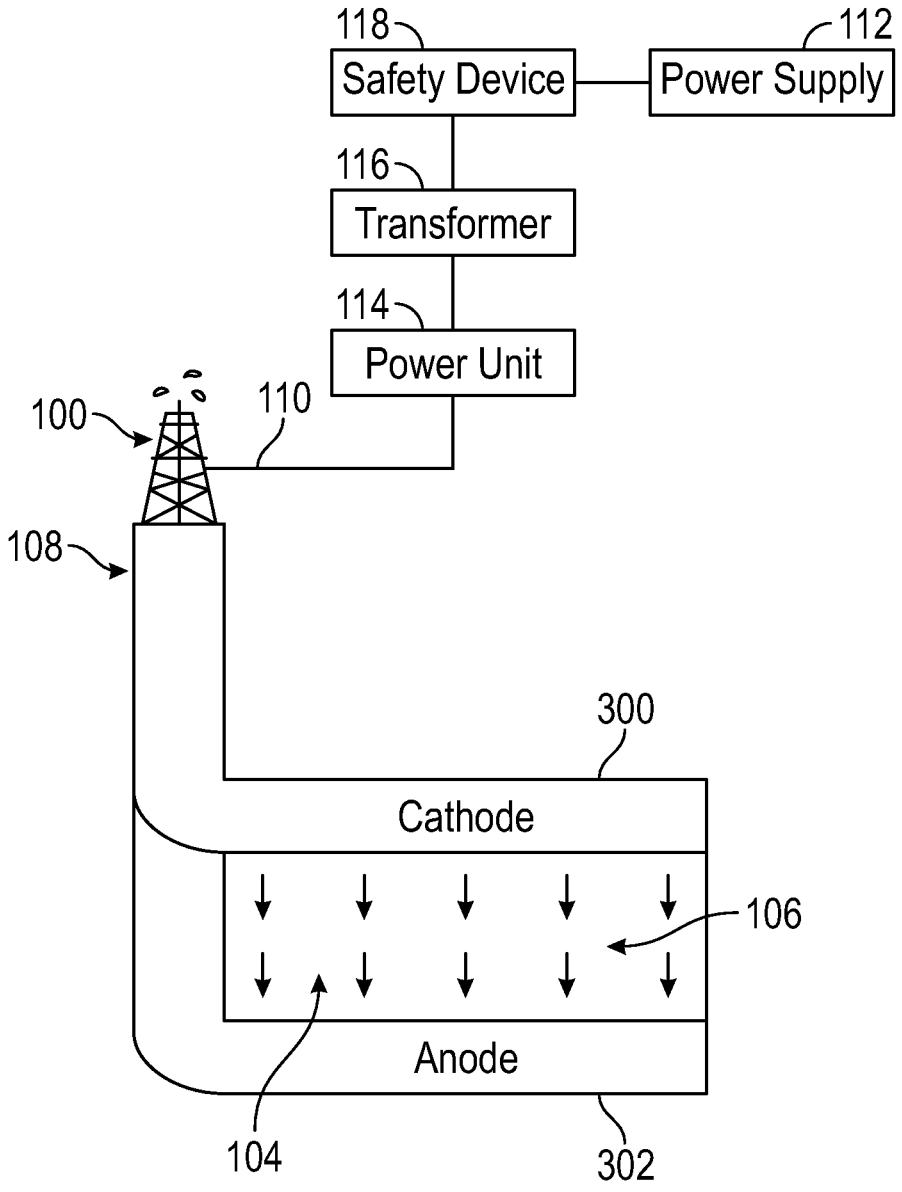
FIGS. 3 and 4 show an electrical arrangement in a stacked dual lateral well in accordance with one or more embodiments.
Figure 4:
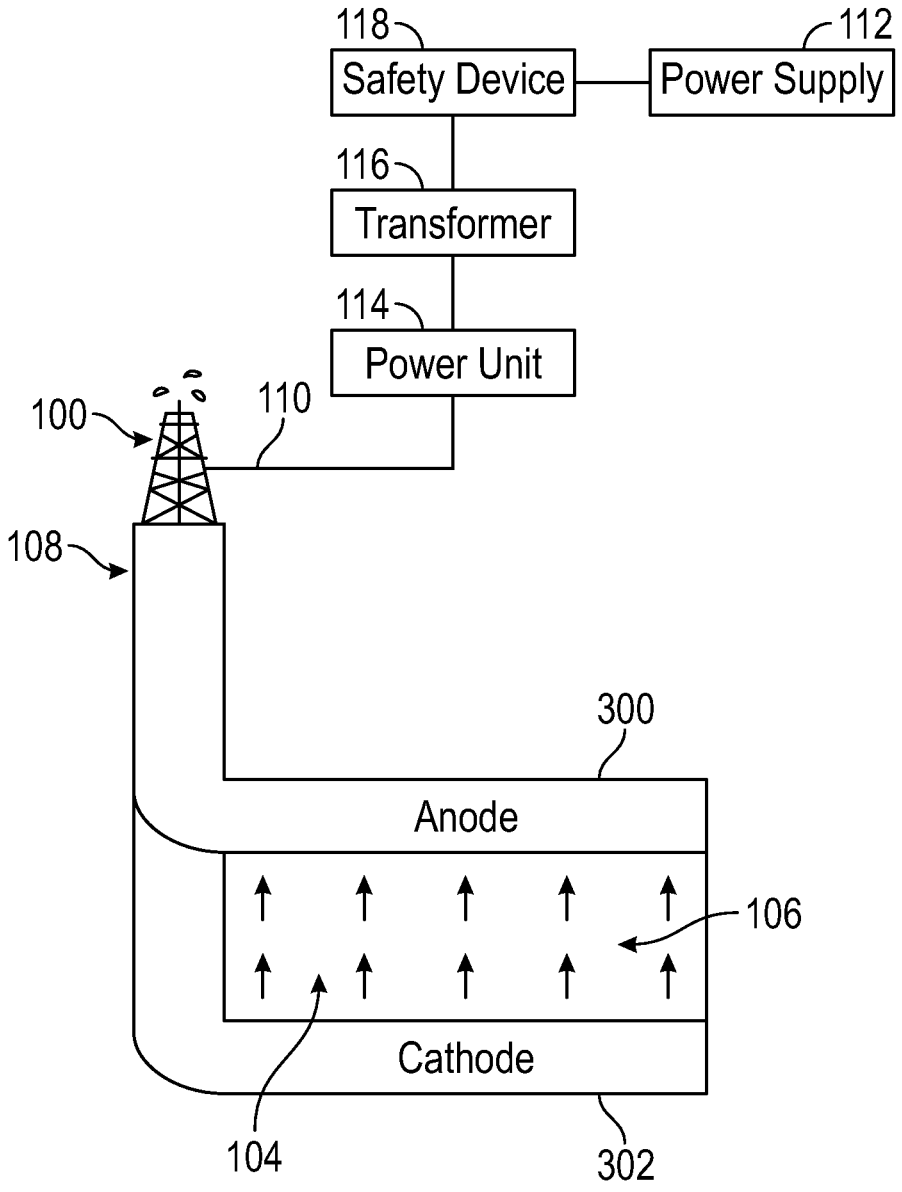

FIGS. 3 and 4 show an example arrangement of the system in accordance with one or more embodiments. FIGS. 3 and 4 show the system in a stacked dual lateral well which involves the placement of two electrodes between two laterals blocked by water. The first well (100) is represented as a first lateral (300). In FIG. 3, the first lateral (300) may be a cathode. The second well (102) is represented as a second lateral (302). The second lateral (302) may be an anode. The first lateral (300) and the second lateral (302) may be horizontally stacked involving blocked water between them. In FIG. 4, the polarity of the first lateral (300) and the second lateral (302) is reversed, where the first lateral (300) is the anode and the second lateral (302) is the cathode.

Figure 5:
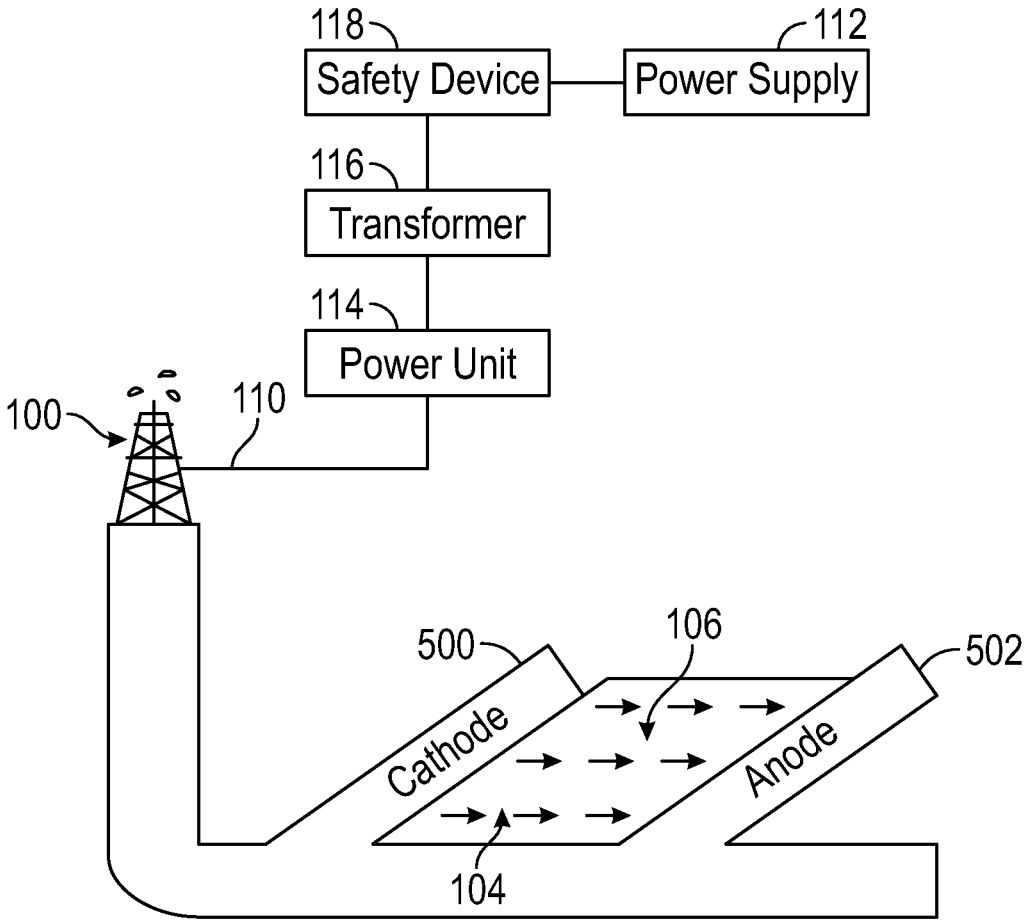
FIGS. 5 and 6 show an electrical arrangement in a planar multi-lateral well in accordance with one or more embodiments.
Figure 6:
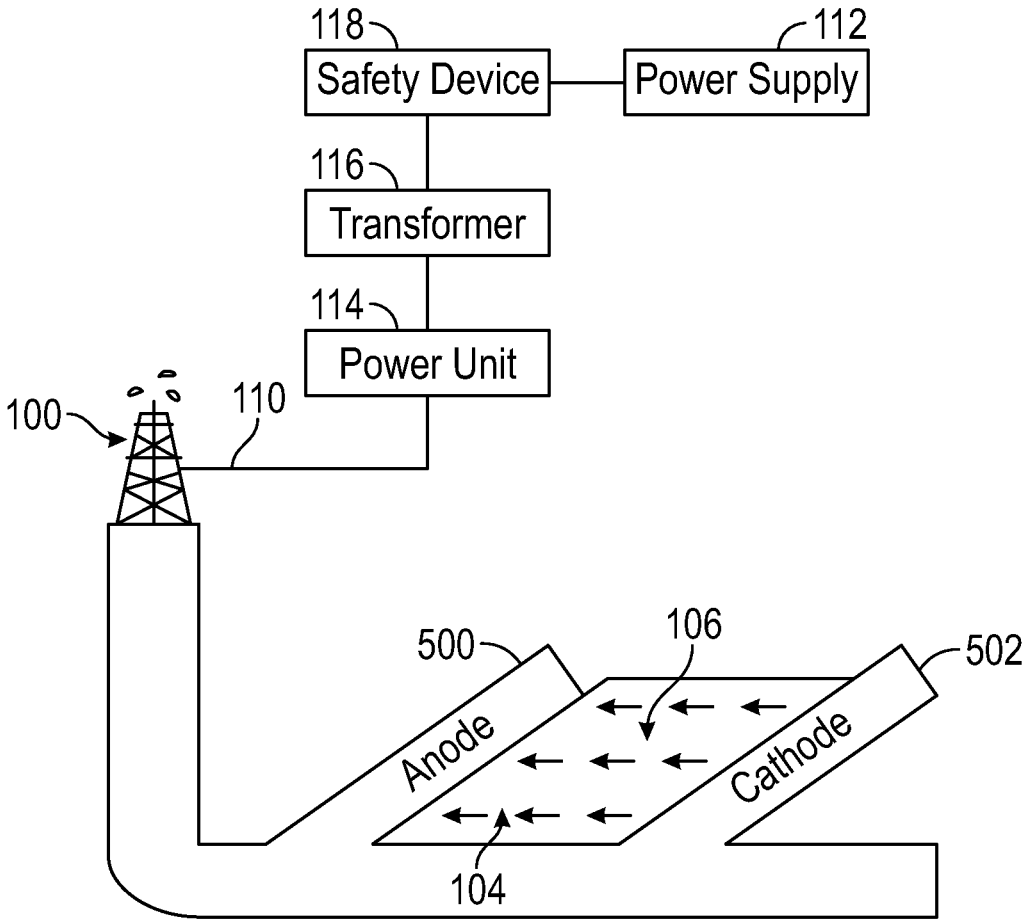

FIGS. 5 and 6 show an example arrangement of the system in accordance with one or more embodiments. FIGS. 5 and 6 show the system in a planar multi-lateral well which involves the placement of two electrodes between two laterals blocked by water. The first well (100) is represented as a first planar lateral (500). The second well (102) is represented as a second planar lateral (502). In FIG. 5, the first planar lateral (500) is the cathode and the second planar lateral (502) is the anode. In FIG. 6, the opposite is shown, where the first planar lateral (500) is the anode and the second planar lateral (502) is the cathode, again by reversing the polarity of the electrical line in each well.

Figure 7:
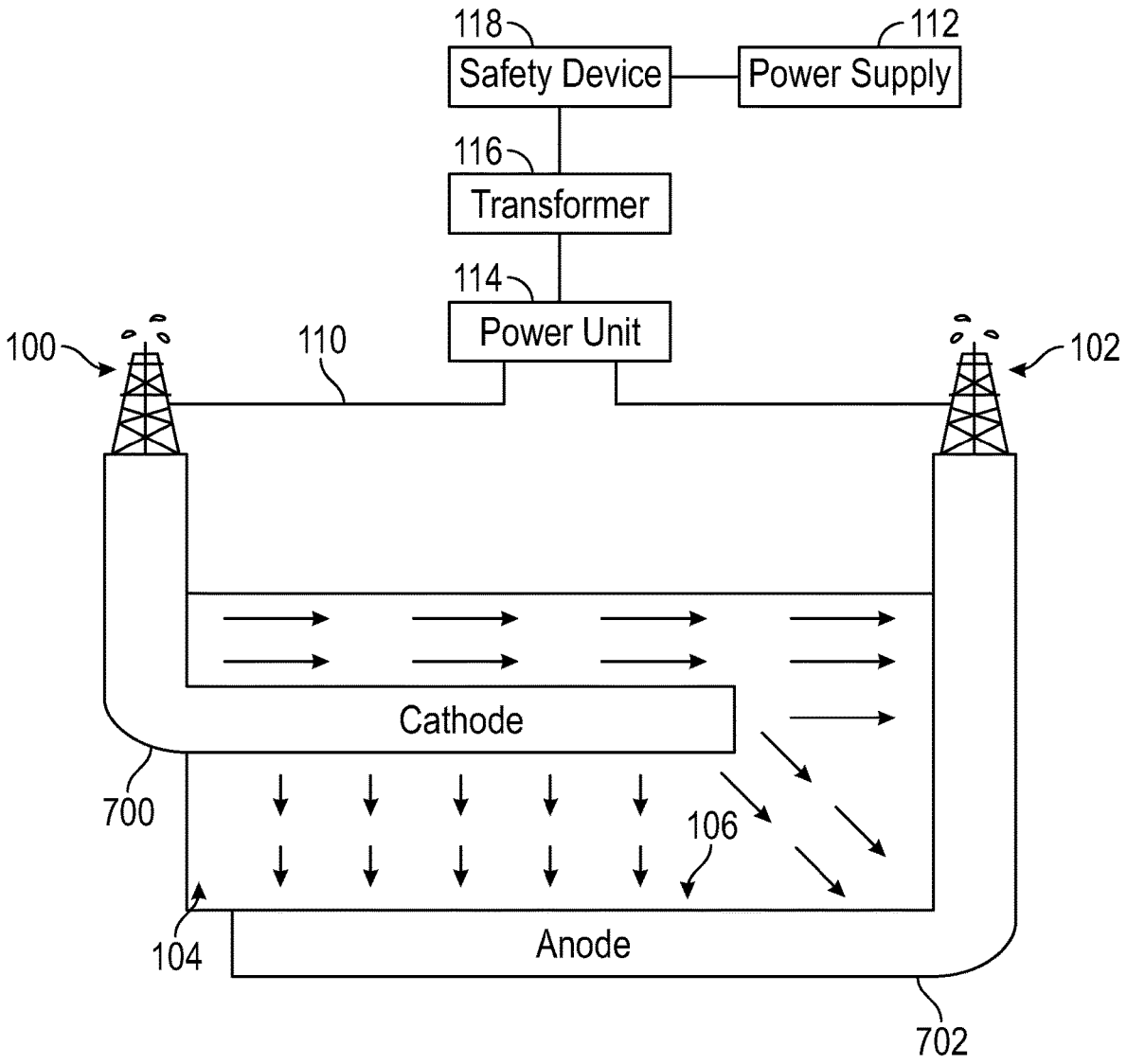
FIGS. 7 and 8 show an electrical arrangement between two horizontal wells in accordance with one or more embodiments.
Figure 8:
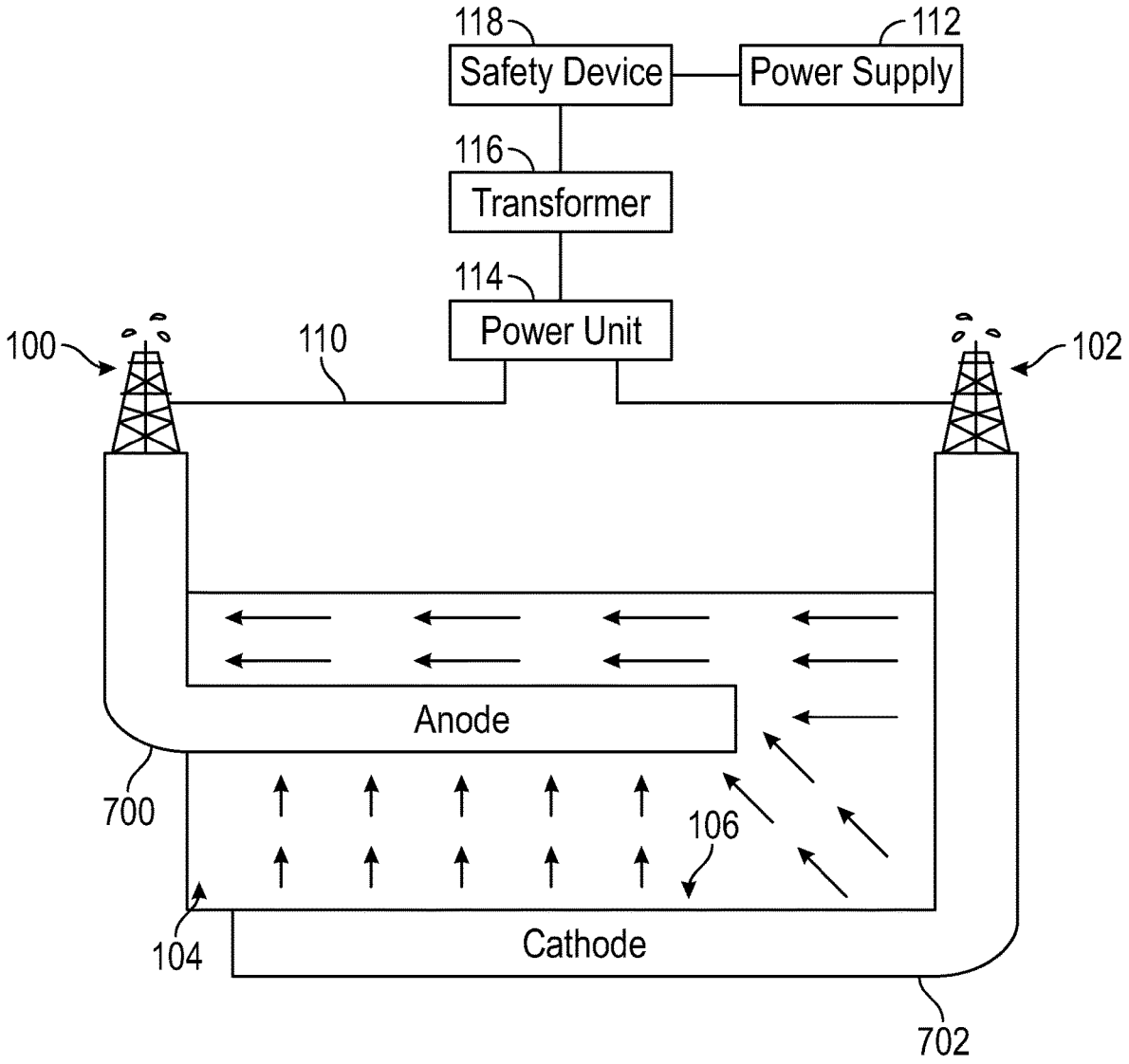

FIGS. 7 and 8 show an example arrangement of the system in accordance with one or more embodiments. FIGS. 7 and 8 show the system involving the placement of two electrodes between two horizontal wells blocked by water. The first well (100) is represented by a first horizontal well (700). The second well (102) is represented by a second horizontal well (702). In FIG. 7, the first horizontal well (700) is the cathode and the second horizontal well (702) is the anode. In FIG. 8, the first horizontal well (700) is the anode and the second horizontal well (702) is the cathode. The arrows in the figures show the flow of current from the cathode to the anode.

Figure 9:
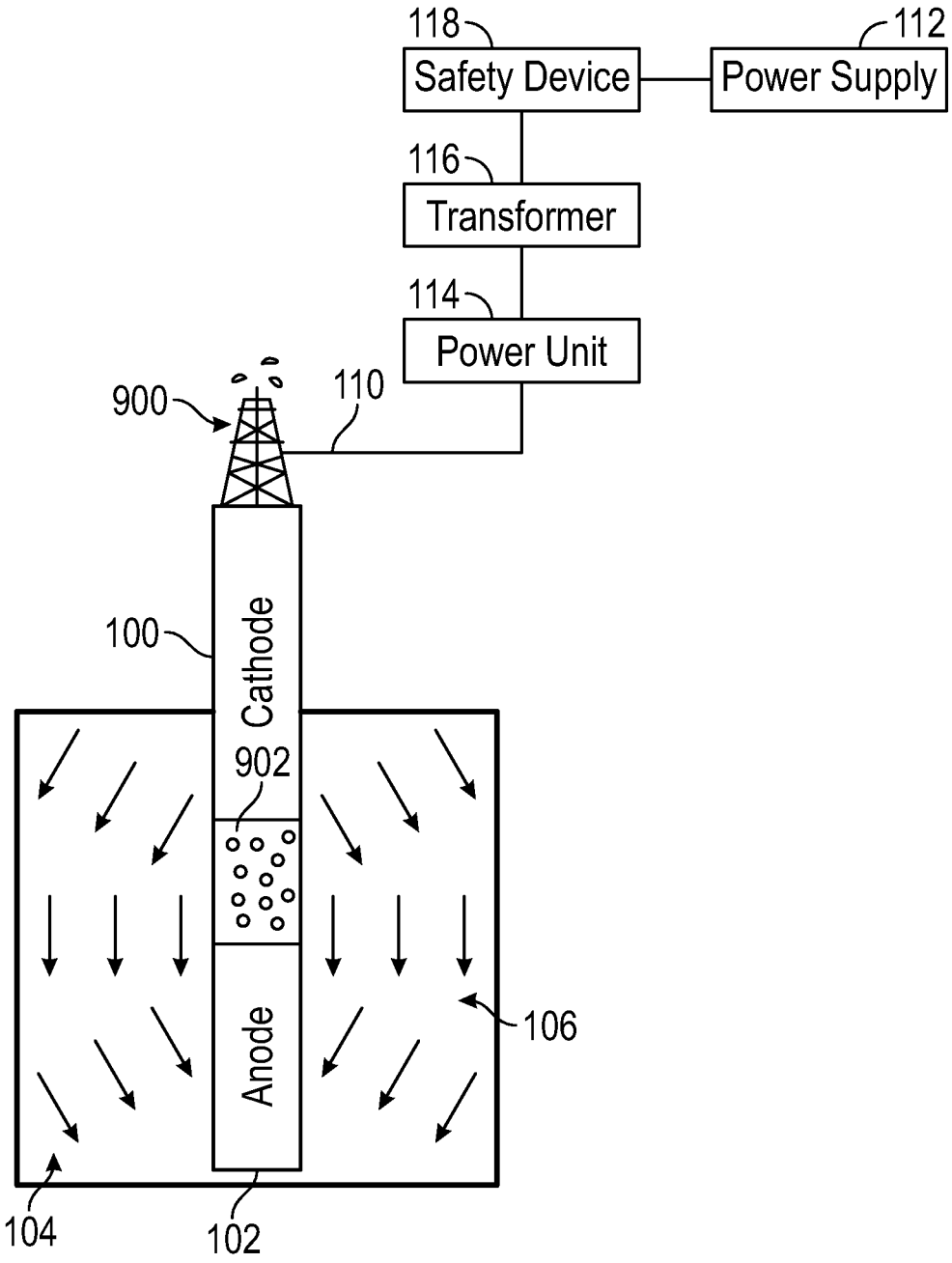
FIGS. 9 and 10 show an electrical arrangement in a vertical perforated well in accordance with one or more embodiments.
Figure 10:
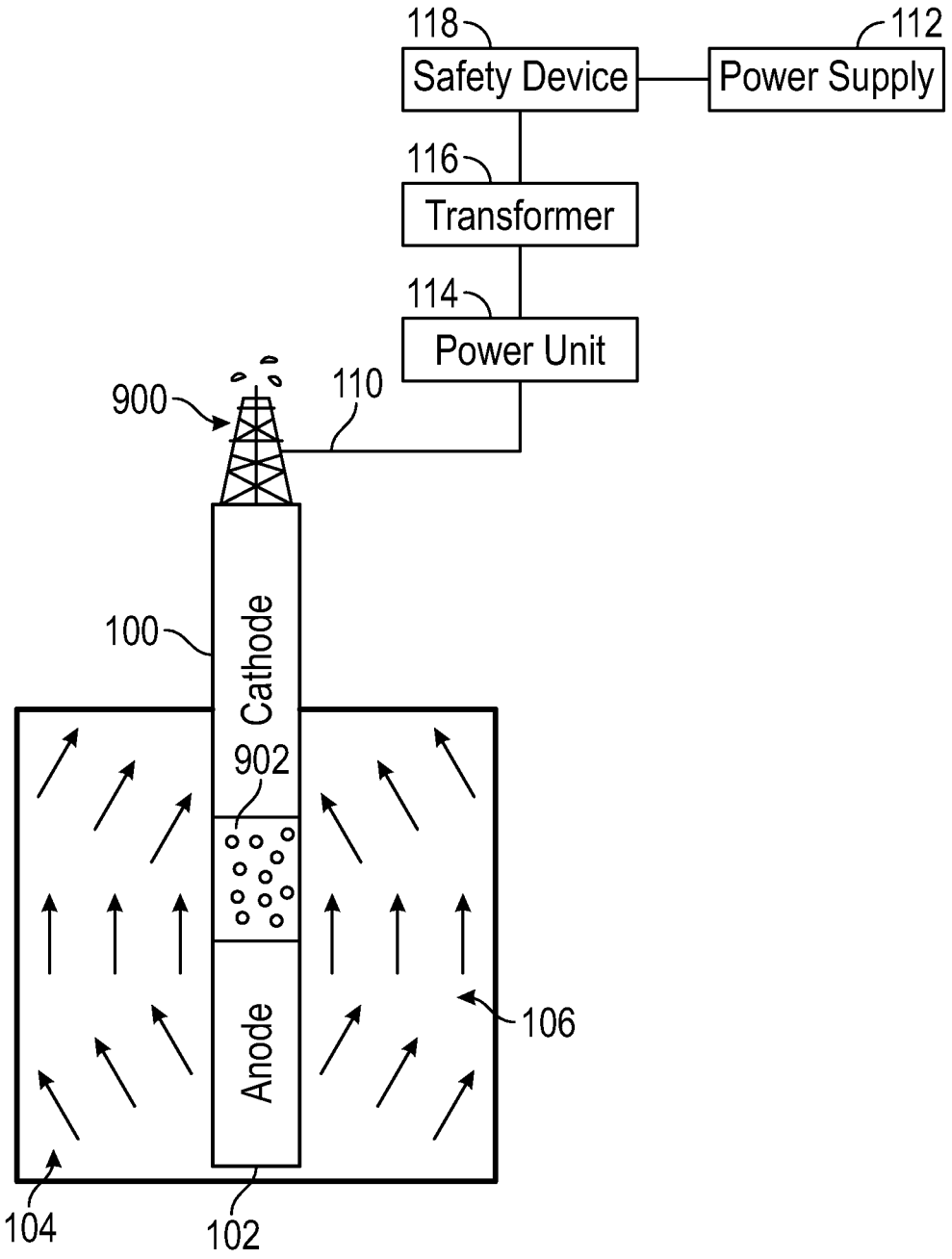

FIGS. 9 and 10 show an example arrangement of the system in accordance with one or more embodiments. FIGS. 9 and 10 show the system involving the placement of two electrodes in a vertical perforated well (900) blocked by water. The first well (100) and the second well (102) are represented in the same vertical perforated well (900). The water blocks the vertical perforated well (900) on both sides. The first well (100) and the second well (102) may be separated by the perforations (902). In FIG. 9, the first well (100) is the cathode and the second well (102) is the anode. In FIG. 10, the opposite configuration is shown, where the first well (100) acts as the anode and the second well (102) acts as the cathode.

Figure 11:
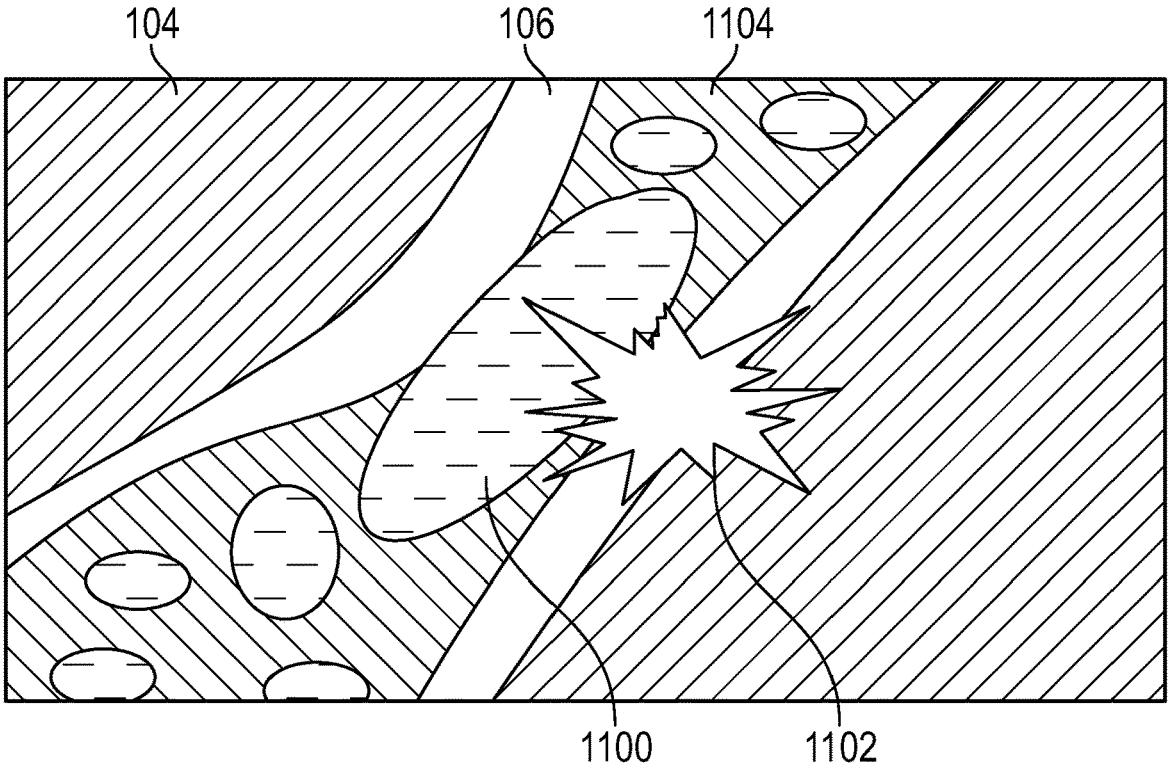
FIGS. 11 and 12 show a schematic illustration of a pore space in accordance with one or more embodiments.
Figure 12:
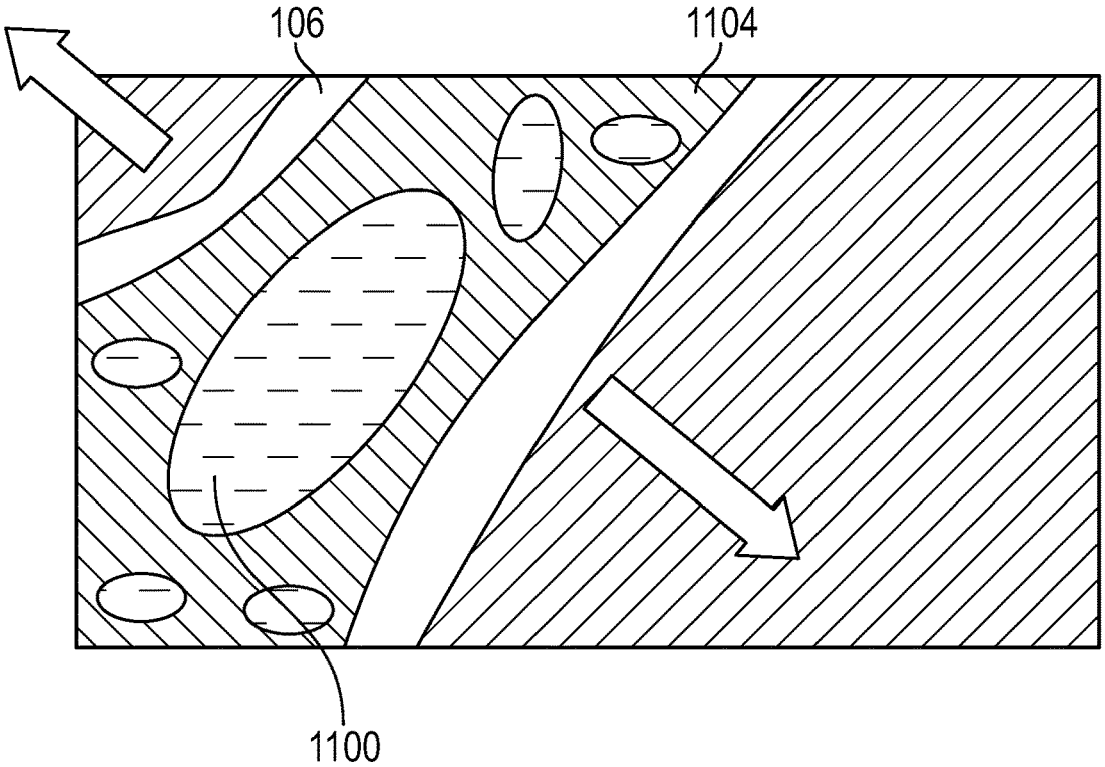

FIGS. 11 and 12 show a schematic illustration of the increase and expansion in the pore spaces (106) by applying the electrical treatment to the reservoir (104). FIG. 11 shows the pore space (106) before electrical treatment. The pore space (106) may have a tight and small pore throat formed due to strong attraction between positive poles of water molecules (1100) to surface and positive cations. Further, FIG. 11 shows an example of the electric current (1102) application to the pore space (106) with water molecules (1100) surrounded by gas (1104). FIG. 12 shows the pore space (106) after application of the electric current (1102). The pore space (106) may increase in radius due to motion of the water molecules (1100), cations and anions. Partial electrolysis may occur from the release of water into gas (1104) bubbles. The water released from the plurality of pore spaces (106) by the electric current may form a plurality of gas (1104) droplets or bubbles.

Figure 13:
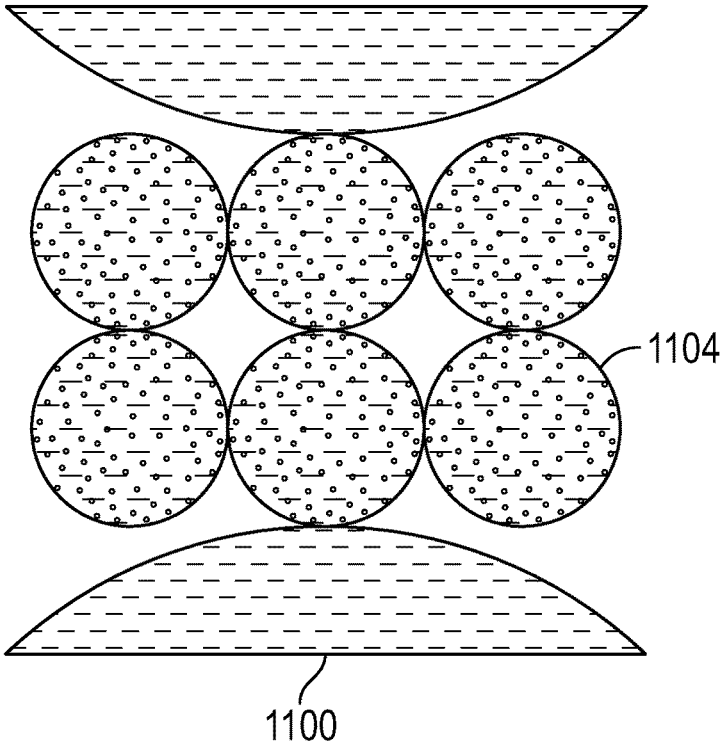
FIGS. 13 and 14 show an illustration in accordance with one or more embodiments.
Figure 14:
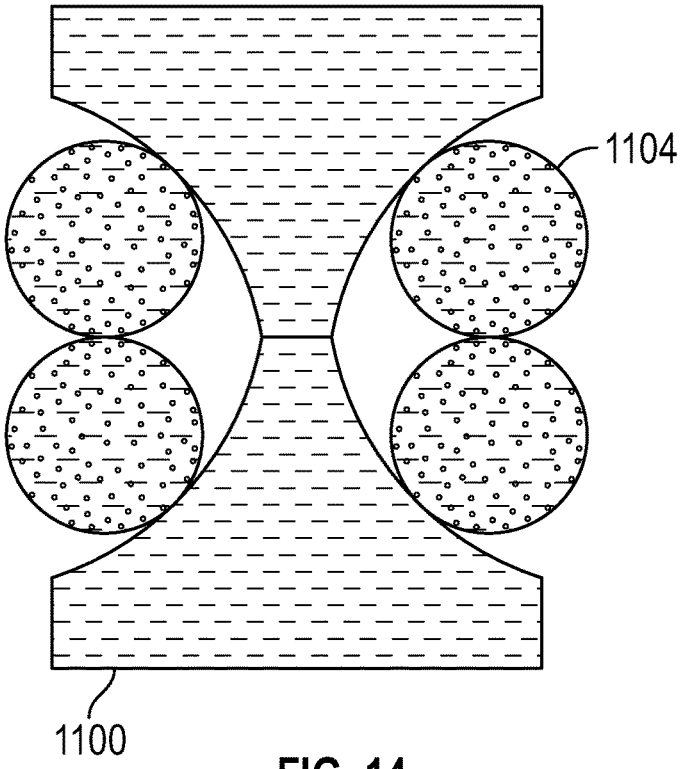

FIGS. 13 and 14 show an illustration of the water molecules (1100) and the gas (1104) bubbles before and after application of the electrical treatment. FIG. 13 shows the water molecules (1100) surrounding the gas (1104) bubbles before the electrical treatment under a high electric field. FIG. 12 shows the water molecules (1100) forming a coalescence after electrical treatment. The water molecules (1100) may form a continuous film of water to minimize surface energy and ease the movement of the water molecules (1100). A major portion of water molecules (1100) released from the electrical treatment may be connected for easy mobilization and removal.

Figure 15:
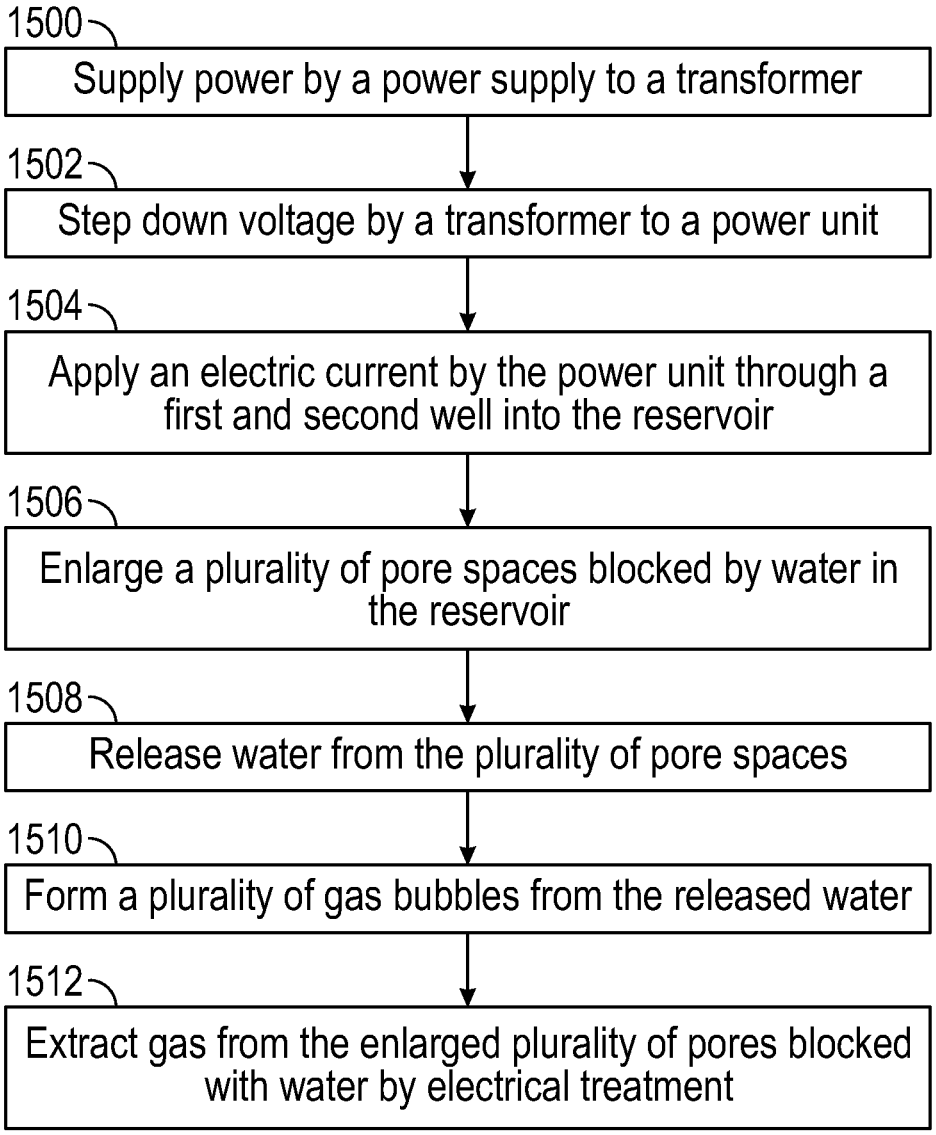
FIG. 15 shows a flowchart in accordance with one or more embodiments.

FIG. 15 shows a flowchart in accordance with one or more embodiments. Specifically, the flowchart illustrates a method for applying electrical treatment to dead gas wells. Further, one or more blocks in FIG. 15 may be performed by one or more components as described in FIGS. 1-14. While the various blocks in FIG. 15 are presented and described sequentially, one of ordinary skill in the art will appreciate that some or all of the blocks may be executed in parallel. Furthermore, the blocks may be performed actively or passively.

Initially, power is supplied to a transformer (116) by a power supply (112) in a system (Block 1500). The power supply (112) may be connected to the transformer by a power cable (110). The transformer (116) may by connected to a power unit (114) by the power cable (110). The power supply (112) may be disconnected from the transformer (116) at a predetermined voltage by a safety device (118). The safety device may be protection controlled automatic equipment. In Block 1502, the transformer (116) steps down voltage to the power unit (114). In Block 1504, an electric current is applied by the power unit (114) through a first well (100) and a second well (102) into the reservoir (104). The first well (100) and the second well (102) may act as electrodes. Specifically, the first well (100) acts as a first electrode, and the second well (102) acts as a second electrode, or vice versa, depending on the polarity connection of the power cable to the power supply (112). For example, the first well (100) may be a cathode and the second well (102) may be an anode. The first well (100) and the second well (102) may have metallic casing that acts as a conductor for electric currently supplied by the power cable (110). The first well (100) and the second well (102) may be gas wells. The reservoir (104) may have a higher water saturation relative to gas saturation. The first well (100) and the second well (102) are hydraulically connected. The electric current may be applied to a wellhead of the first well (100) and the second well (102). The electric current may propagate through the metallic casing all the way to a pay zone delivering to the reservoir (104).

In Block 1506, a plurality of pore spaces (106) blocked by water in the reservoir (104) are enlarged. The plurality of pore spaces (106) may be saturated with water. The local electric current may pulse in the reservoir (104) to enlarge the throats of the pore spaces (106) leading to water releasing through porous media. In Block 1508, the plurality of pore spaces (106) release the water by the enlargement of the pore spaces (106). In Block 1510, a plurality of gas (1104) bubbles are formed from the released water. The electric current may cause partial electrolysis forming gas droplets or bubbles (1104) from some of the released water. In Block 1512, the gas (1104) bubbles are extracted and produced from the enlargement of the pore spaces (106) by the electrical treatment. The gas (1104) bubbles are produced and extracted from the first well (100) and the second well (102). The electrical treatment method may be moved from one reservoir (104) to another for continual application.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A system for electrical treatment in a reservoir with gas wells, the system comprising:

a first well in the reservoir configured to act as an electrode, wherein the reservoir comprises a plurality of pore spaces saturated by water;

a second well in the reservoir configured to act as a second electrode hydraulically connected to the first well;

a power unit connected to the first well and the second well by a cable configured to emit an electric current to the first well and the second well into the reservoir, wherein the electric current enlarges the plurality of pore spaces in the reservoir, facilitating a production of gas from the water; and a transformer connected to the power unit by the cable, the transformer configured to step down a voltage from a power supply to the power unit, wherein the power supply is connected to the transformer by the cable, wherein the first well and the second well are dead gas wells.

2. The system of claim 1, further comprising:

a safety device configured to disconnect the power supply from the transformer at a predetermined voltage.

3. The system of claim 2, wherein the safety device is a protection controlled automatic equipment.

4. The system of claim 1, wherein the first well is a cathode and the second well is an anode.

5. The system of claim 1, wherein water released from the plurality of pore spaces by the electric current forms a plurality of gas droplets.

6. The system of claim 1, wherein the first well and the second well each comprise a metallic casing.

7. The system of claim 1, wherein the reservoir has a higher water saturation relative to a gas saturation.

8. A method for electrical treatment in a reservoir with gas wells, the method comprising:

supplying power by a power supply connected to a transformer by a cable to a power unit, wherein the transformer is configured to step down a voltage from the power supply to the power unit, applying an electric current by the power unit through a first well and a second well into the reservoir, wherein the first well, configured to act as a first electrode, is hydraulically connected to the second well that is configured to act as a second electrode;

enlarging a plurality of pore spaces in the reservoir by application of the electric current, wherein the plurality of pore spaces is saturated with water; and releasing water from the plurality of pore spaces by the enlargement of the plurality of pore spaces, wherein the first well and the second well are dead gas wells.

9. The method of claim 8, further comprising:

forming a plurality of gas bubbles from the released water; and producing the plurality of gas bubbles from the first well and the second well.

10. The method of claim 8, further comprising:

disconnecting the power supply from the transformer at a predetermined voltage by a safety device.

11. The method of claim 10, wherein the safety device is a protection controlled automatic equipment.

12. The method of claim 8, wherein the first well is a cathode and the second well is an anode.

13. The method of claim 8, wherein the first well and the second well each comprise a metallic casing.

14. The method of claim 8, wherein the reservoir has a higher water saturation relative to a gas saturation.

* * * * *